United States Patent [19]

Santo

[11] Patent Number: 4,501,036

[45] Date of Patent: Feb. 26, 1985

[54] FLOATATION SLEEP SYSTEM

[76] Inventor: Philip J. Santo, 12 Mountain Rd., Rochester, N.Y. 14625

[21] Appl. No.: 450,023

[22] Filed: Dec. 15, 1982

[51] Int. Cl.[3] ..... A47C 27/10

[52] U.S. Cl. ..... 5/452; 5/451

[58] Field of Search ..... 5/451, 452, 449, 450, 5/455, 441, 474

[56] References Cited

U.S. PATENT DOCUMENTS

| | | | |
|---|---|---|---|
| 3,735,432 | 5/1973 | Kreten et al. | 5/451 |
| 3,918,110 | 4/1975 | Cantillo et al. | 5/452 |
| 4,100,635 | 7/1978 | Mitchell et al. | 5/452 |
| 4,181,990 | 1/1980 | Santo | 5/452 |
| 4,245,364 | 1/1981 | Calleance | 5/451 |

*Primary Examiner*—Alexander Grosz

*Attorney, Agent, or Firm*—Lawrence P. Kessler

[57] ABSTRACT

An improved floatation sleep system for supporting a body. The improved floatation sleep system has a first chamber adapted to contain a liquid and a second chamber adapted to contain pressurized air. The second chamber surrounds the perimeter of the first chamber to support the marginal edges of such first chamber. The improvement comprises dividing the second chamber into mutually independent cells. A plurality of valves associated with the independent cells respectively allow the cells to be individually filled with pressurized air. As an additional aspect of this invention, a flexible, dimensionally stable, fluid impervious sheet is connected to the second chamber and extends across the bottom of the first chamber in order to capture any fluid leaking from the first chamber.

7 Claims, 4 Drawing Figures

FLOATATION SLEEP SYSTEM

BACKGROUND OF THE INVENTION

This invention relates generally to floatation sleep systems, and more particularly to the mattress of a floatation sleep system of improved construction.

Floatation sleep systems, commonly referred to as waterbeds, have become a popular alternative to conventional bedding. Such popularity is due to the fact that waterbeds provide totally balanced body support which has been found to induce a superior state of relaxation. The first waterbeds were free standing, flexible bladders filled with water. However, since the free standing bladder was flexible in all directions, it was necessary that it have a vertical dimension (height) to prevent "bottoming out" when the body was supported on the bladder. This height made it awkward to get on and off the bladder, and the fact that the side walls of the bladder were flexible made sitting on the edge difficult. Therefore, a rigid frame was added, the frame being located around the lateral marginal edges of the flexible bladder. While the frame supported the bladder to maintain a desired height and prevent bottoming out, sitting on the edge and getting in and out of the waterbed over the frame was still uncomfortable.

In order to improve the comfort of the waterbed, the frame was replaced by compressible air chambers along the lateral marginal edges of the flexible bladder, such as shown in U.S. Pat. Nos. 3,778,852 issued Dec. 18, 1973 in the name of Penn et al and 4,079,473 issued Mar. 21, 1978 in the name of Philips, for example. The air chamber provided comfort when entering and exiting the bed and when sitting on the edge thereof, and in addition maintained the fluid bladder at a desired height to prevent bottoming out. However, the air chamber is subject to deterioration at the seals between the air chamber and the central liquid chamber (bladder). When the air chamber is breached by liquid at the seals or by an external puncturing of the chamber, the air chamber collapses and the entire waterbed has to be replaced. Moreover, when the liquid enters the air chamber, the air is forced from a portion of such chamber and so that the entire waterbed becomes unbalanced to the point where it may roll off of the supporting structure.

SUMMARY OF THE INVENTION

This invention is directed to an improved floatation sleep system for supporting a body. The improved floatation sleep system has a first chamber adapted to contain a liquid and a second chamber adapted to contain pressurized air. The second chamber surrounds the perimeter of the first chamber to support the marginal edges of such first chamber. The improvement comprises dividing the second chamber into mutually independent cells. A plurality of valves associated with the independent cells respectively allow the cells to be individually filled with pressurized air. As an additional aspect of this invention, a flexible, dimensionally stable, fluid impervious sheet is connected to the second chamber and extends across the bottom of the first chamber in order to capture any fluid leaking from the first chamber.

The invention, and its objects and advantages, will become more apparent in the detailed description of the preferred embodiment presented below.

BRIEF DESCRIPTION OF THE DRAWINGS

In the detailed description of the preferred embodiment of the invention reference is made to the accompanying drawing, in which.

DESCRIPTION OF THE PREFERRED EMBODIMENT

Figure 1:
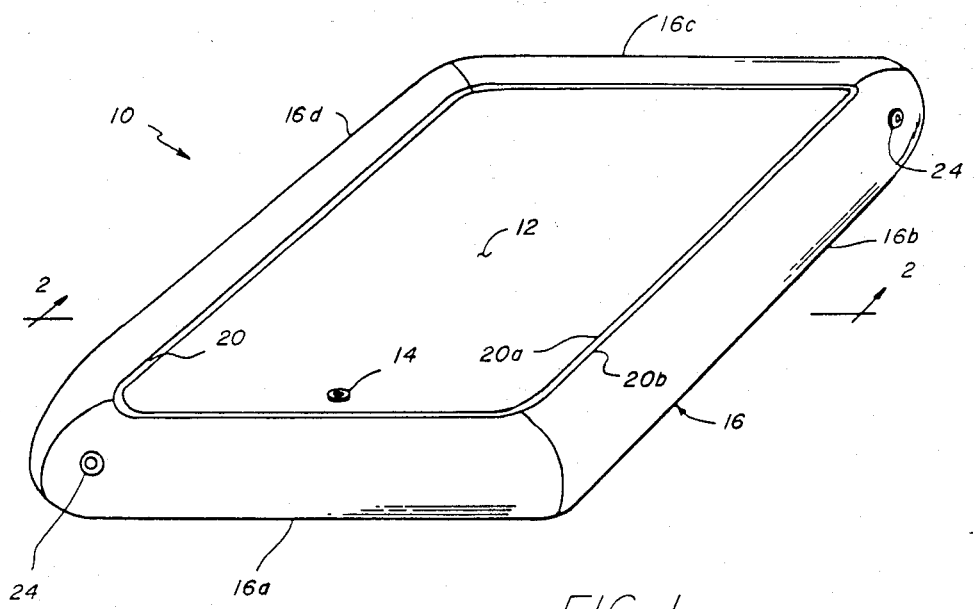
FIG. 1 is an isometric top-front view, of the improved floatation sleep system according to this invention.
Figure 2:
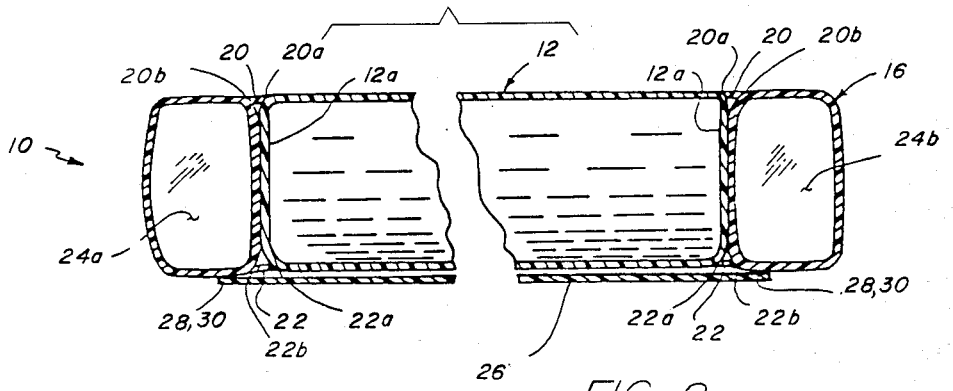
FIG. 2 is a cross-sectional view of the improved floatation sleep system taken along the lines 2—2 of FIG. 1.
Figure 3:
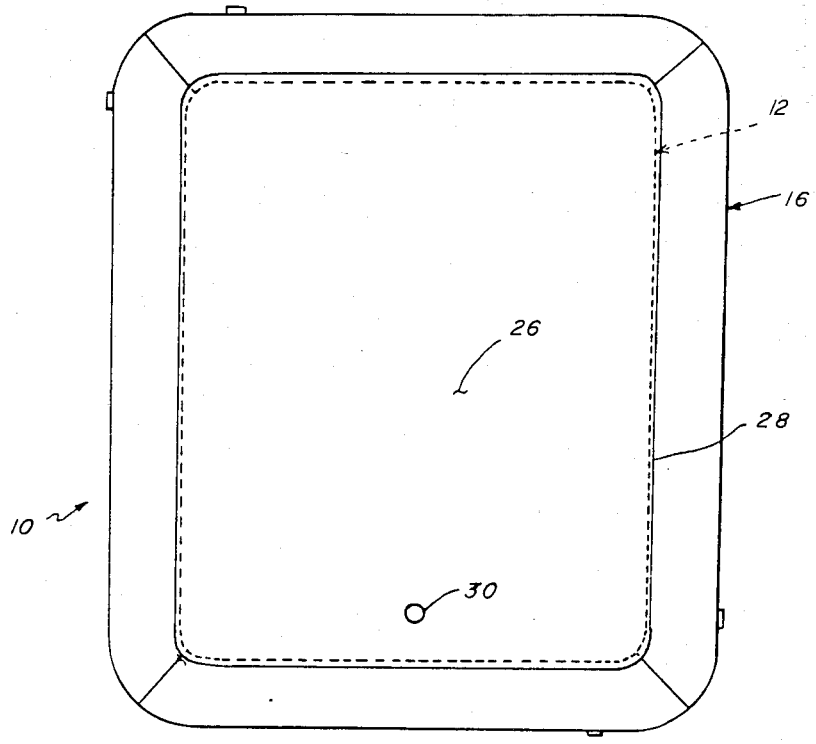
FIG. 3 is a bottom plan view of the improved floatation sleep system of FIG. 1.

Referring now to the accompanying drawings, the improved floatation sleep system, or waterbed, of this invention is designated generally by the numeral 10. As best shown in FIGS. 1 and 2 the waterbed 10 includes a bladder member 12. The bladder member 12 is formed of a flexible, dimensionally stable fluid impervious material, such as polyethelene or polypropelene for example. The bladder member is a chamber of substantially rectangular prism in configuration, but may be of any other suitable shape. The bladder has a valve 14, of any well known type, for filling of the bladder member with a suitable liquid such as water for example. The bladder member 12 is surrounded by a marginal edge perimeter support 16. The perimeter support 16 is formed of dimensionally stable, flexible material, similar to that forming the bladder member, in a continuous cylinder surrounding the upstanding marginal edge 12*a* of the bladder member 12. The perimeter support 16 is interconnected with the bladder member 12 by segments 20, 22 of flexible dimensionally stable material heat sealed along the marginal edges 20*a*, 22*a* to the bladder member 12, and along the marginal edges 20*b*, 22*b* to the perimeter support 16.

Figure 4:
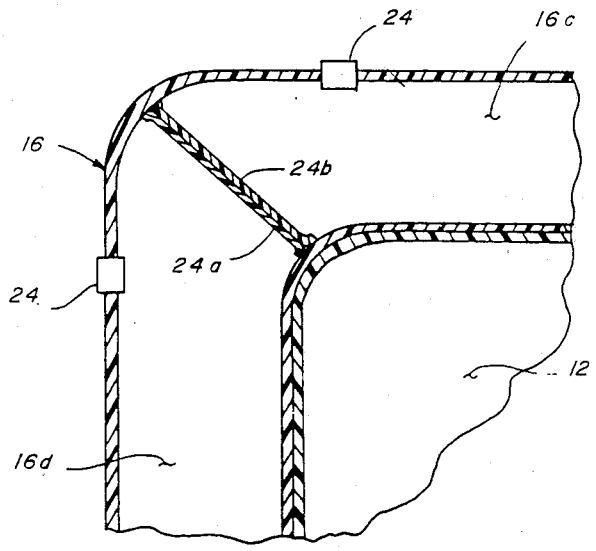
FIG. 4 is a cross-sectional view, on an enlarged scale, of one corner of the improved floatation sleep system of FIG. 1.

The cylinder of the perimeter support 16 is divided into individual independent cells 16*a*, 16*b*, 16*c* and 16*d* by sheets of flexible, dimensionally stable material 24*a*, 24*b* (e.g. similar to material forming the bladder member), heat sealed along their perimeter edges to such cylinder (see FIG. 4). Each cell 16*a*, 16*b*, 16*c* and 16*d* has a valve 24, of any well known type, for admitting pressurized air to the individual cells. By dividing the perimeter chamber 16 into such individual cells, a puncture or loss of air pressure in one of the cels does not destroy the integrity of the entire perimeter. As discussed above this is an important feature of this invention in that, if the integrity of one of the cells is breached, repair can be made to that cell alone without having to replace the entire mattress as would be the case with waterbeds of the prior art. Moreover, when the cell that is breached collapses, the remaining cells retain their pressurization, and thus their shape, to provide support for the perimeter of the bladder member 12. This prevents water in the bladder member from migrating into the perimeter support far enough to change the original center gravity of the bladder member to cause the bladder member to roll off its support.

Another aspect of the improved floatation sleep system 10, is a mechanism by which the standard waterbed liner is substantially eliminated. To accomplish the elimination of such liner, a flexible, dimensionally stable sheet 26 of fluid impervious material, such as polyethelene or polypropelene for example, is heat sealed along the line 28 to the perimeter support 16 outwardly of the seal **22*b* by which the segment 22 is joined to the perimeter support. The sheet 26 will thus serve to entrap any fluid leaking from the bladder member 12. In this manner the liner of the prior art waterbeds is rendered unnecessary. The sheet 26 may include a valve 30 of any well known type, for draining entrapped fluid. Of course, the valve could communicate directly with the bladder member 12** for draining the fluid within such member.

The invention has been described in detail with particular reference to a preferred embodiment thereof, but it will be understood that variations and modifications can be effected within the spirit and scope of the invention.

I claim:

1. An improved floatation system, for supporting a human body, comprising:

a first chamber formed of flexible, dimensionally stable, fluid impervious material and adaptd to contain a fluid;

a second chamber formed of flexible, dimensionally stable, fluid impervious material and adapted to contain pressurized air, said second chamber surrounding the marginal perimeter of said first chamber for supporting such first chamber;

means, adjacent to said first chamber and extending through said second chamber, for dividing said second chamber into independent cells; and a plurality of valves, associated with said independent cells respectively, adapted to enable said cells to be independently pressurized.

2. The invention of claim 1 wherein said means for dividing said second chamber into independent cells comprises a plurality of sheets of flexible, dimensionally stable sheets respectively extending transversely of said second chamber at spaced intervals and sealed to the perimeter of said second chamber.

3. The invention of claim 2 wherein, when said first chamber is in the shape of a rectangular prism and said second chamber is in the shape of a continuous cylinder, said plurality of sheets respectively extend transversely of said second chamber adjacent to the corners of said first chamber.

4. The invention of claim 1 wherein said floatation system further comprises a flexible, dimensionally stable, fluid impervious sheet, connected to said second chamber and extending across the bottom of said first chamber to entrap any liquid escaping from said first chamber.

5. A floatation system for supporting a human body comprising:

first chamber means for containing a liquid, said first chamber means having integral top, bottom and side walls formed of a flexible, dimensionally stable fluid impervious material;

second chamber means for supporting said side walls of said first chamber means, said second chamber means having means located adjacent to said side walls and extending outwardly therefrom through said second chamber means for dividing said second chamber into independent cells; and a flexible, dimensionally stable, fluid impervious sheet connected to said second chamber and underlying said first chamber to entrap any fluid escaping from said first chamber.

6. The invention of claim 5 wherein said means for dividing said second chamber into independent cells comprises a plurality of sheets of flexible, dimensionally stable sheets respectively extending transversely of said second chamber at spaced intervals and sealed to the perimeter of said second chamber.

7. The invention of claim 6 wherein said second chamber means further comprises a plurality of valves associated with said independent cells respectively, and adapted to enable said cells to be independently inflated with pressurized air.

* * * * *